United States Patent [19]

Yang

[11] Patent Number: 4,648,585

[45] Date of Patent: Mar. 10, 1987

[54] VISE STRUCTURE HAVING ARTICULATABLE VISE JAWS

[76] Inventor: Tai-Her Yang, 5-1 Taipin St., Si-Hu Town, Dzan-Hwa, Taiwan

[21] Appl. No.: 742,599

[22] Filed: Jun. 7, 1985

[51] Int. Cl.[4] ..... B25B 1/10

[52] U.S. Cl. ..... 269/104; 269/155; 269/156; 269/228; 269/242; 269/262; 269/901

[58] Field of Search ..... 269/104, 106-107, 269/109, 111, 113, 114, 118, 140, 152-156, 221, 228, 240, 242, 244, 258, 262, 901

[56] References Cited

U.S. PATENT DOCUMENTS

| | | | |
|---|---|---|---|
| 1,372,661 | 3/1921 | Secord | 269/156 |
| 1,372,833 | 3/1921 | Sauer | 269/228 X |
| 1,730,510 | 10/1929 | Jensen | 269/242 X |
| 1,966,338 | 7/1934 | Eggimann | 269/109 X |
| 2,552,094 | 5/1951 | Hamon et al. | 269/156 |
| 2,617,457 | 11/1952 | Warwick | 269/242 X |
| 4,527,786 | 7/1985 | Hsu | 269/154 |

FOREIGN PATENT DOCUMENTS

| | | | |
|---|---|---|---|
| 13818 | 10/1956 | Fed. Rep. of Germany | 269/107 |

*Primary Examiner*—Frederick R. Schmidt
*Assistant Examiner*—Steven P. Schad
*Attorney, Agent, or Firm*—Leonard Bloom

[57] ABSTRACT

A vise structure has a control handle cooperating with a two-part guide rod means, including respective inner and outer rods mounted telescopically relative to each other. The handle is rotatably supported on the frame and has a limited longitudinal movement thereon. In one longitudinal position, the handle is coupled only to the inner rod for rotation in unison; and the inner rod is linked to a pair of pivotably-mounted vise jaws arranged to move towards and away from each other transversely of the vise structure. In a second position of the handle, both the inner and outer rods are rotated for movement of the pivotably-mounted vise jaws and, respectively, for longitudinal movement of a transversely-arranged elongated vise jaw from one end of the structure to its other end. In a third position of the handle, only the outer end is rotated for movement of only the elongated vise jaw. The vise structure is adapted for a work bench and is arranged to clamp various irregularly-shaped work pieces therein.

3 Claims, 32 Drawing Figures

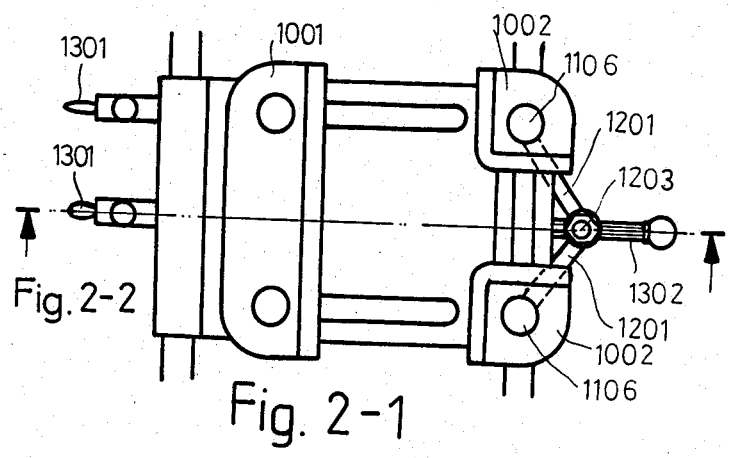
Fig. 2-2
Fig. 2-1
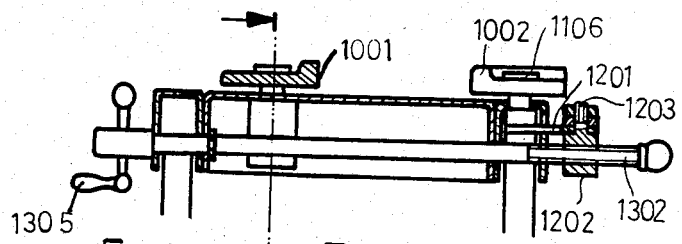
Fig.2-3
Fig. 2-2
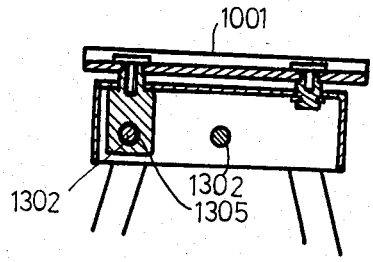
Fig. 2-3

VISE STRUCTURE HAVING ARTICULATABLE VISE JAWS

BACKGROUND OF THE INVENTION

With respect to the design of this vise structure, the following prior art is known to the applicant:

U.S. Pat. Nos. 2,322,380; 3,841,619; 4,169,606; 4,155,386; 4,252,304; 4,330,113

The currently designed multi-directional clamp work benches to clamp irregularly-shaped work pieces, and the vise structures of the prior art, often have the following defects:

(1) The clamping function requires movement in at least two operational directions; and/or (2) The machine base has a framework which hampers the clamping of the work pieces on the floor (such as a door during its repair).

SUMMARY OF THE INVENTION

However, the preferred embodiments of the improved design of the clamp work bench and vise structure of the present invention alleviate the above-listed one or two defects, so this is a new design of the vise structure fully capable of clamping irregular work pieces. Its main features are as follows:

The single handle has an integral sleeve associated with the guide rod structure for conducting multi-directional operations, thereby providing the work bench user with a vise structure having convenient and wide applications for a variety of irregularly-shaped work pieces.

BRIEF DESCRIPTION OF THE DRAWINGS

FIG. 1-1 is a top plan view thereof, oriented 180 degrees from the position in FIG. 1.

FIG. 1-2 is a longitudinal cross-sectional view of the structure shown in FIG. 1-1.

FIG. 1-3 is an end view thereof.

FIG. 1-4 is an exploded isometric view of the sleeve and handle of the vise structure shown in FIG. 1.

FIG. 1-5 is a cross sectional view thereof, showing an inner threaded rod telescoped within an outer threaded rod, and further showing both the inner and outer rods telescoped within the sleeve formed integrally with the handle of the vise structure.

FIG. 1-6 shows the sleeve telescopically received over the respective end portion of the inner rod and mechanically coupled thereto to transmit rotary motion to the inner rod only, thereby moving the pivotally mounted vise jaws transversely of the frame of the work bench.

FIG. 1-7 shows the sleeve telescopically received over the respective end positions of both the inner and outer rods and coupled thereto to simultaneously transmit rotary motion to both rods, thereby moving all of the vise jaws.

FIG. 1-8 shows the sleeve telescopically received over both the inner and outer rod, but mechanically coupled only to the outer rod to transmit rotary movement thereto, thereby moving only the transversely-arranged vise jaw on the frame of the work bench.

FIG. 1-9 is an isometric view (partially exploded) of an alternate embodiment of the present invention, showing an alternate vise structure associated with a work bench.

FIG. 2 is an isometric view of a further alternate embodiment of the present invention.

FIG. 2-1 is a top plan view thereof.

FIG. 2-2 is a longitudinal cross-sectional view thereof, taken across the lines 2-2 of FIG. 2-1.

FIG. 2-3 is a cross-sectional view thereof, taken across the lines 2-3 of FIG. 2-1.

FIG. 3 is an isometric view (partially exploded) of a further alternate embodiment of the present invention.

FIG. 3-1 is a top plan view thereof.

FIG. 3-2 is a longitudinal cross-sectional view thereof, taken across the lines 3-2 of FIG. 3-1.

FIG. 3-3 is a further longitudinal cross-sectional view thereof, taken across the lines 3-3 of FIG. 3-1.

FIG. 3-4 is a front view thereof.

FIG. 3-5 is an isometric view (partially exploded) of another alternate embodiment of the present invention.

FIG. 4 is an isometric view of yet another embodiment of the present invention.

FIG. 4-1 is a top plan view thereof.

FIG. 4-2 is a longitudinal cross-sectional view thereof, taken across the lines 4-2 of FIG. 4-1.

FIG. 4-3 is a further cross sectional view thereof.

FIGS. 5–5-7 are the diagrammatic views of typical applications of the vise structure of the present invention.

For convenience, the part number descriptions are listed as follows:

1001 elongated board-shaped longitudinal movable vise jaw
1002 rotatable (or pivotable) and transversely movable vise jaws
1101 bracket secured to vise jaw 1001
1102 slide block
1103 fixing screws for securing bracket 1101 to vise jaw 1001
1104 control screw
1105 washer
1106 pivot pin for the rotatable (pivotable) vise jaws
1107 long support board of the movable clamp claw
1201 link support arm
1202 link post with central threads
1203 central rod of the link joint
1301 guide rod handle
1302 rod means
1303 threaded outer rod
1304 threaded inner rod
1305 guide rod screw hole
1306 guide rod with two-directional threads
1307 limiting pin
1308 transmission pin
1309 positioning and transmission steel head
1310 spring
1311 fixing plug

DETAILED DESCRIPTION OF THE PREFERRED EMBODIMENTS

During working at home, farm, carport or basement, a man often needs to do some simple repair work himself, or he does some amateur manufacturing jobs according to his own interests. Usually he has to do a number of different jobs such as drilling, planing, sawing, filling, gluing, etc. Therefore, a work bench with good functions to clamp the work pieces becomes a necessity. For this purpose, a wide variety of work benches have been designed and marketed. Unfortunately, such designed work benches have many defects. Before design of this invention, the inventor has made references to the following issued U.S. Patents: U.S. Pat. Nos. 2,322,380; 3,841,619; 4,169,606; 4,155,386; 4,252,304; 4,330,113; and in response to their structural characteristics and defects, the vise structure of the present invention has been made.

Figure 1:
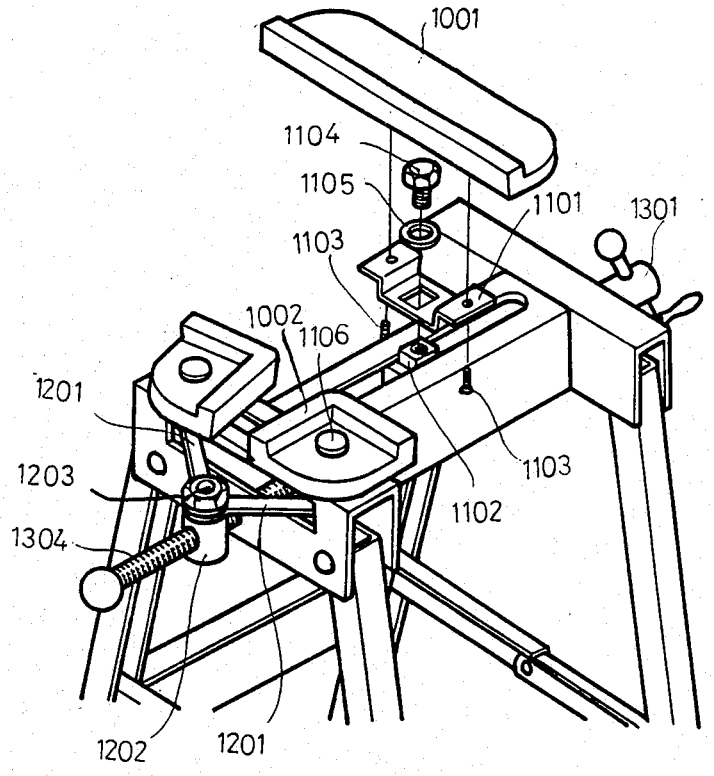
FIG. 1 is an isometric view (partially exploded) showing the preferred embodiment of the single-side single-handle operational and control pull-rod 3 jaw type vise structure for a work bench or other applications.
Figure 1:
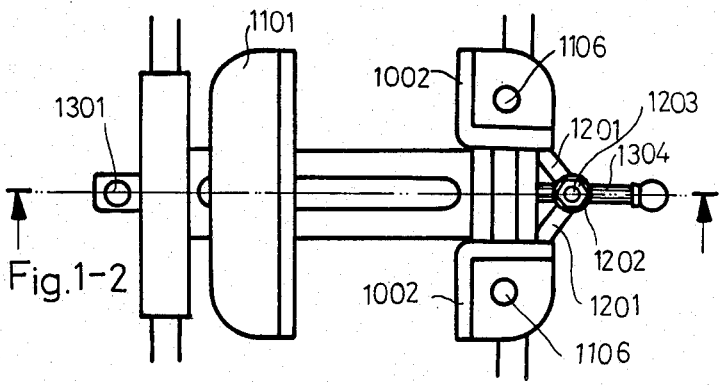

As shown in FIG. 1, the preferred embodiment of the present invention is illustrated. The vise structure is operated on a single side of the workbench and is single-handle operated by means of controlled pull-rod that is rotatably mounted in the frame of the work bench and has a limited longitudinal movement therein. The work bench is of the three jaw type for clamping in the single-handle operation to achieve the functions of left-and-right clamping and front-and-back clamping under various operations. The vise structure is simple and easy to operate and has rotatable clamping jaws to clamp work pieces in any shapes, such as round, triangle, irregular, parallel or inwardly concave forms as shown more clearly in FIGS. 5-5-4. When the user does not want the clamp jaws to become rotatable, he may drive the left and right clamp jaw set (mutually closing against each other) to use their edges to clamp a small work piece as shown in FIG. 5-5. Additionally, its other numerous functions include opposite joining as shown in FIG. 5-6; also, setting a work piece vertically on a floor for inspection and repair as shown in FIG. 5-7.

The main features of the vise structure of the present invention are as follows:

The central rod 1106 of the two sets of rotatable (pivotable) clamp jaws 1002, respectively, passes through a link support arm 1201, respectively. One end of the link support arm 1201 goes through the central rod 1203 of the link rod joints and couples to a sidewise guide rail and can slide therebetween.

The other end of link support arms 1201, respectively, has a central hole. These central holes mutually overlap and also join the link post 1202.

The longitudinal guide screw (or rod means) 1302 has a screw hole to accommodate the link post 1202. The rod means functions to alter the angle formed by the link support arms 1201; and as a result, the two rotatable (pivotable) clamp jaws 1002 move transversely of the frame of the work bench to move towards or away from one another.

The vise structure includes a flat board-type clamp jaw 1001 which can make a relatively close approach or opposite movement (longitudinally of the frame of the work bench and from one end portion thereof to the other end portion thereof) in conjunction with the rotatable (pivotable) clamp 1002. A support rack and a slide block with screw holes are jointed to the under side of the said structure to take the driving of the two-part lengthwise guide rod means.

The structure of the two-part guide rod means includes an outer guide screw (or outer threaded rod) 1303 that is a hollow cylindrical structure with a central longitudinal round hole. The guide rod means further includes an inner guide screw (or inner threaded rod) 1304 which is telescopically received within the outer threaded rod 1303, as shown more clearly in FIG. 1-4. The end section of the inner threaded rod 1304 has threads to drive the internally-threaded link post 1202.

As shown more clearly in FIG. 1-4, the inner threaded rod 1304 has an end portion which extends beyond the respective (adjacent) end portion of the outer threaded rod 1303, and both end portions of the inner and outer rods are telescopically received within an elongated sleeve formed integrally with the crank handle 1301. A plurality of longitudinal keyways are formed on the respective end portions of the inner and outer rods, as shown more clearly in FIG. 1-4, and are arranged to communicate (axially) with one another. Pins 1308 and 1309 are received in the respective communicating keyways (which are formed as "blind" key ways) for the purpose of accommodating limited sliding movement of the inner and outer rods relative to the sleeve, yet be selectively coupled to the sleeve for rotation in unison as hereinafter described.

From the above-said structure, during operations, the user only needs to push the handle 1301 for forward or backward movements to select the coupling status of the guide rods, as follows: In FIG. 1-6, the integral sleeve telescopes over the respective end portion of the inner rod 1304, such that the pins 1308 and 1309 are received only in the longitudinal slot of the inner rod 1304, thereby coupling the sleeve to the inner rod 1304 for rotation in unison upon rotation of the handle 1301. In FIG. 1-7, the integral sleeve on the control handle is manually pushed and is retracted within the frame of the work bench to be telescopically received over the respective end portions of the inner and outer rods and is placed at a position to simultaneously transmit rotation to the inner and outer guide rods. In FIG. 1-8, the integral sleeve on the control handle 1301 is telescopically received over the respective end portion of both the inner and outer rods, but is mechanically coupled to only the outer rod 1303 and is placed in a position to transmit rotation to only the outer rod 1303. This structure shifts the operational and control directions to facilitate clamping various irregularly-shaped work pieces. The outer threaded rod 1303 cooperates with a respective nut means to actuate the transversely-arranged, longitudinally-movable vise jaw 1101. The inner threaded rod 1304 cooperates with its respective nut means, including the link post 1201, to actuate the respective link support arms 1201 to in turn move the jaws 1002 transversely of the work bench frame and in a direction towards and away from each other.

FIG. 1-9 shows the preferred embodiment of the guide rail of the structure as illustrated in FIG. 1, that is, provided on both sides of the machine base. The changes of its structure only lie in that both sides of the basic body are provided with guide rails. Also, a long support board 1107 with wider movable clamp jaws is provided; and both sides of the support board 1107 are coupled to the guide rails on both sides for the lengthwise slide movements.

Figures 1, 2:
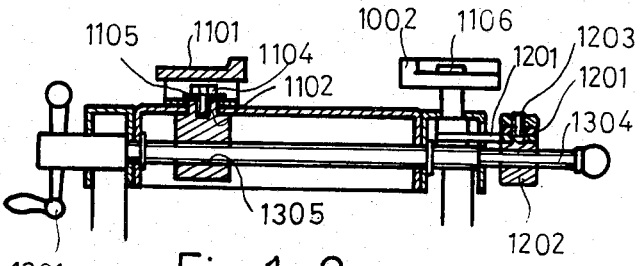
Figures 1, 2, 3:
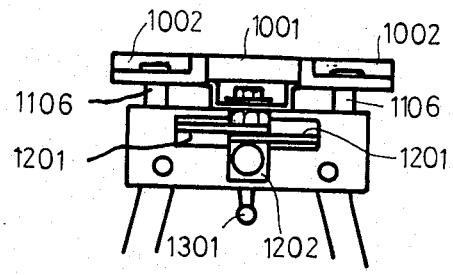

FIG. 2 illustrates the embodiment of the single-side double-handle operational and control pull-rod 3 jaw type clamp work bench. FIG. 2-1 is its top view; FIG. 2-2 is its side cross sectional view; and FIG. 2-3 is its front cross sectional view. The features of this embodiment are that the operated two-part guide rod with its sleeve is replaced by two separate guide rods on the same side. Its middle guide rod drives link rod joint 1202 with central threaded post to pull the clamp jaw set 1022 for left and right displacements, and the guide screws on the sides are to drive the link strip-shaped board-like clamp jaw 1001 for forward and backward displacements.

FIG. 3 shows another embodiment of the single-side three-handle operational and control pull-rod four jaw-type clamp work bench, mainly having the merit to operate on the same side. The major features of its structure are as follows: The machine body has three lines of lengthwise parallel slot-shaped structures, on each of which a lengthwise slide slot is provided, respectively. Such lengthwise slide slots are mutually parallel. The parallel slots are for the slide movements of the slide blocks of the rotatable clamp jaw set, and the middle parallel slots are for the slide movements of the link rod joint 1202 of the post with central threads. It has four sets of rotatable clamp jaws, two sets of which are placed on the same side of the two sides, and the remaining two sets are respectively joined on the support rack of the slide blocks 1102 on the sides. As to the three sets of parallel slot-shaped structures, a sidewise parallel rod passes through each of the front and rear ends of said structures, respectively. The middle slot-shaped structure is positioned by a limiting pin, while the slot-shaped structures on both sides can slide sidewisely along the two parallel rods. A link joint central rod 1203 is provided on the inner side of the said parallel slot-shaped structures on both sides. Two sets of link joint 1202 of the central threaded post are provided on the middle parallel slot-shaped structure. The support rack set is constituted by four sets of links, the left and a right two sets of the joints to connect said four sets of links pass through, and are installed and coupled to the central rod 1203 of the link joint in the inner side in the middle part of the left-and-right parallel slot-shaped structure, while the front and rear two sets pass through and are installed in the link joint 1202 of the central threaded post for movable adjustments. Three sets of parallel same-side operational guide rods, respectively, drive the link joint 1202 of the central threaded post and slide block 1102. The guide screws on both sides drive to respectively adjust the operations of the forward and backward movements for the movable clamp claws on both sides. The middle guide screw drives to pull the pull rod set, thus making the parallel slot-shaped structures on both sides close toward the center or move away to both sides.

From the above-said features, when the left-side guide rod is operated, this makes the left-side clamp jaws mutually close, and the rotatable clamp jaw sets can be rotatably moved according to the profile of the work pieces. When the middle guide rod is operated, this makes the left-and-right clamp jaw sets tightly clamp toward the center, or loosen toward both sides.

Figures 1, 2, 3, 4:
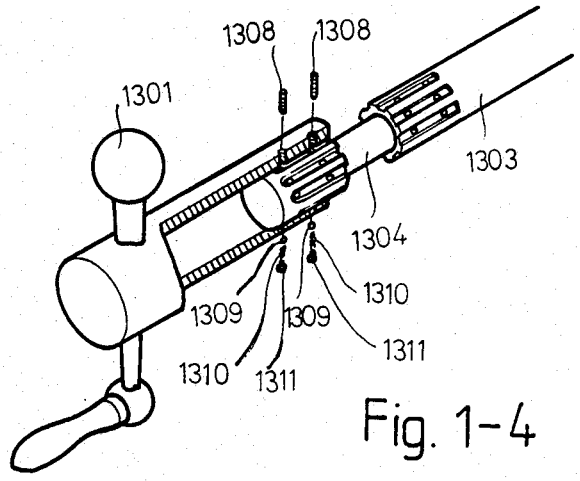
Figures 1, 2, 3, 4, 5:
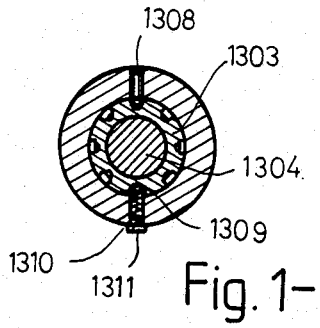
Figures 1, 2, 3, 4, 5, 6:
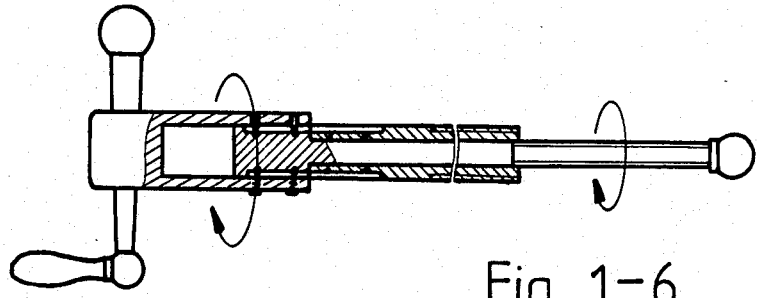
Figures 1, 2, 3, 4, 5, 6, 7:
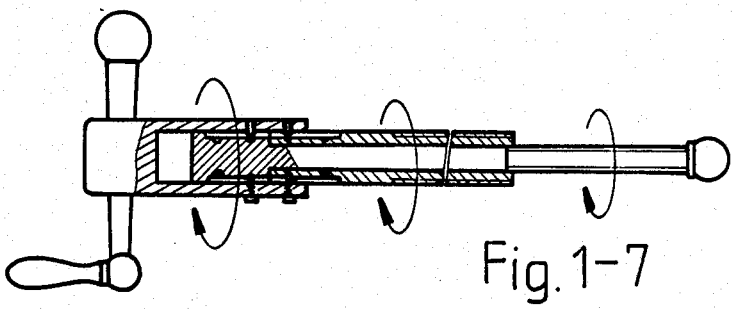
Figures 1, 2, 3, 4, 5, 6, 7, 8:
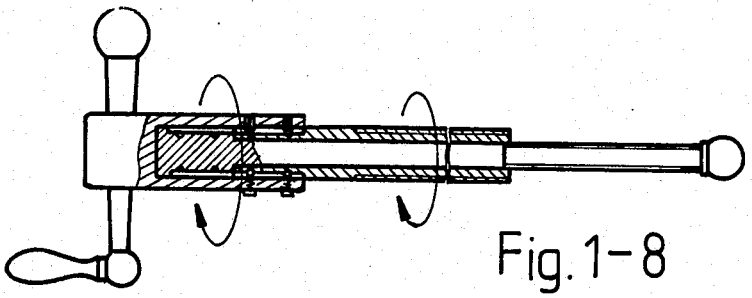
Figures 1, 2, 3, 4, 5, 6, 7, 8, 9:
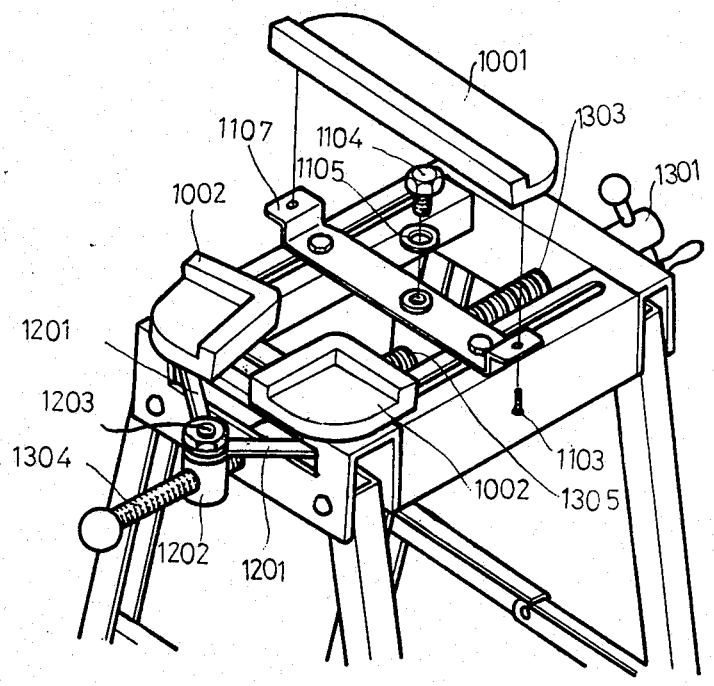
Figure 2:
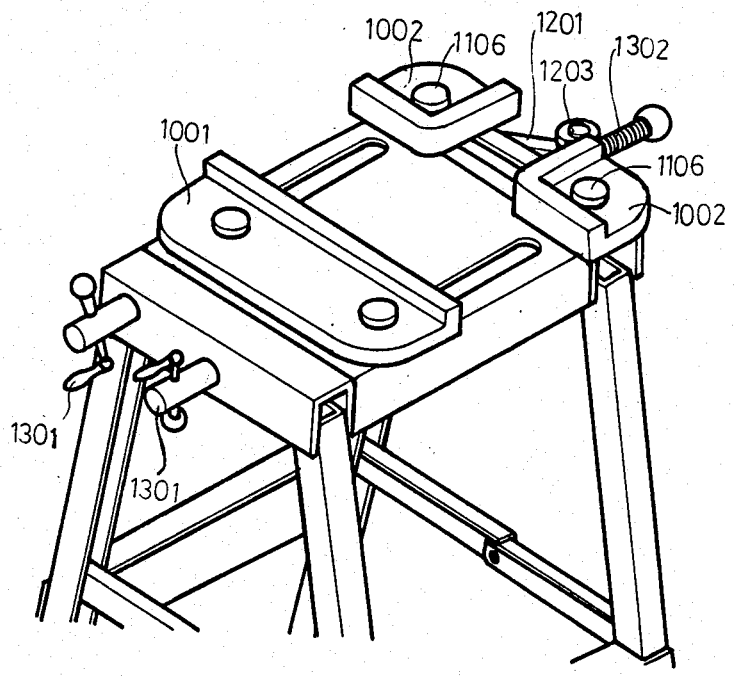
Figure 3:
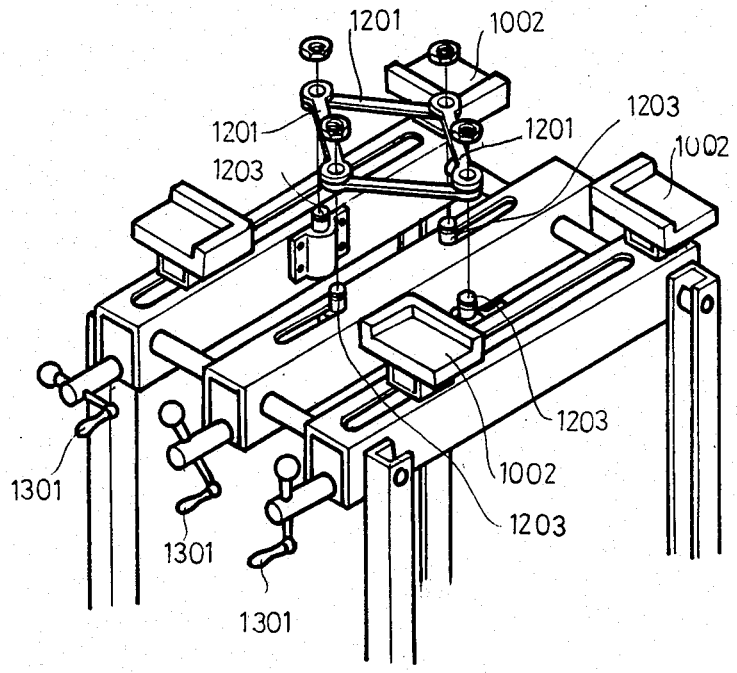
Figures 1, 3:
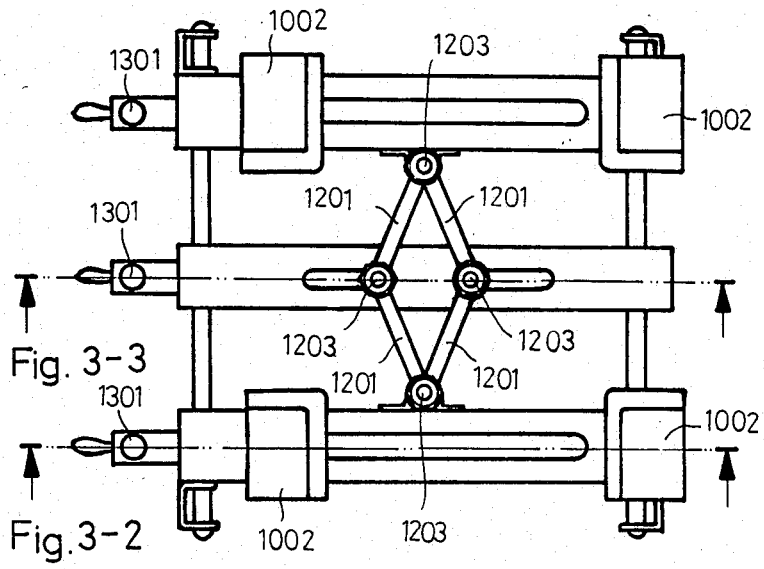
Figures 2, 3:
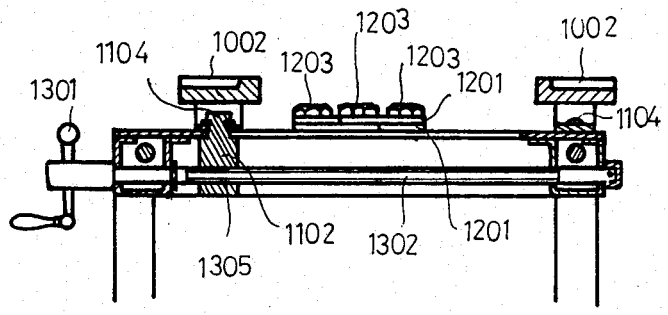
Figure 3:
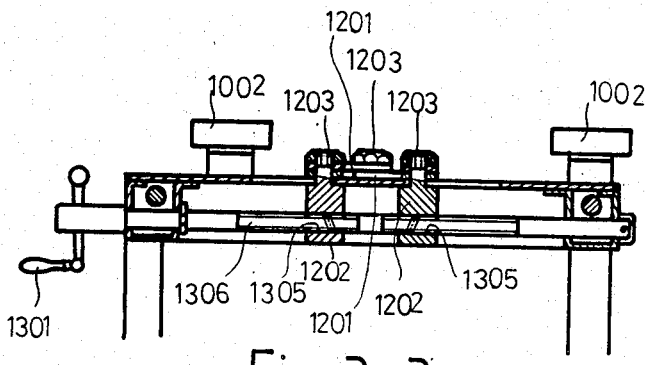
Figures 3, 4:
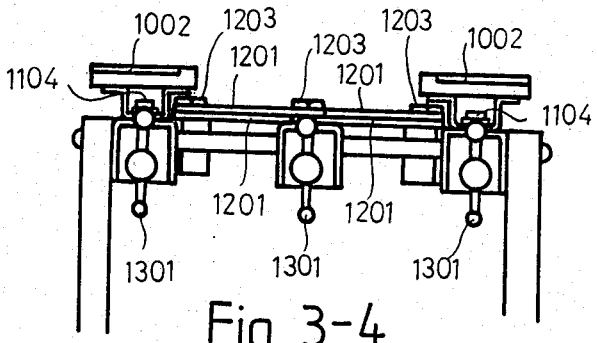
Figures 3, 4, 5:
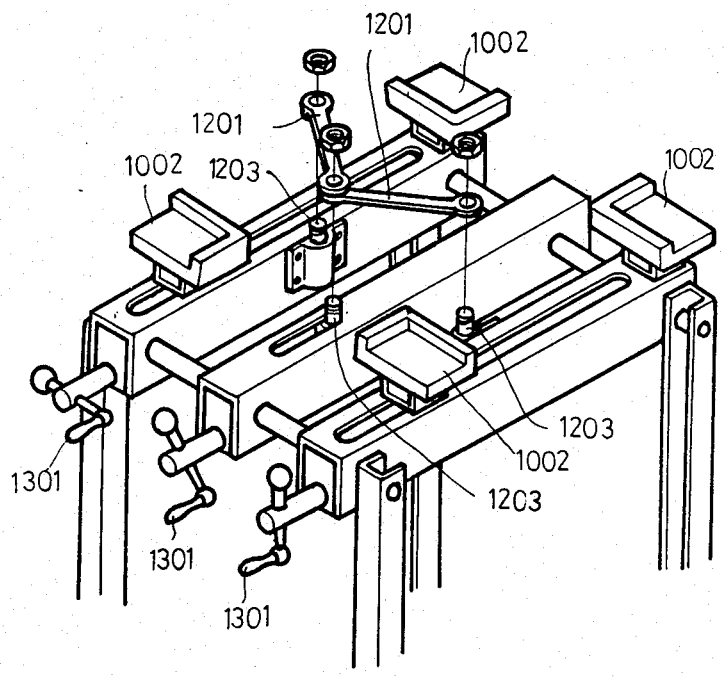
Figure 4:
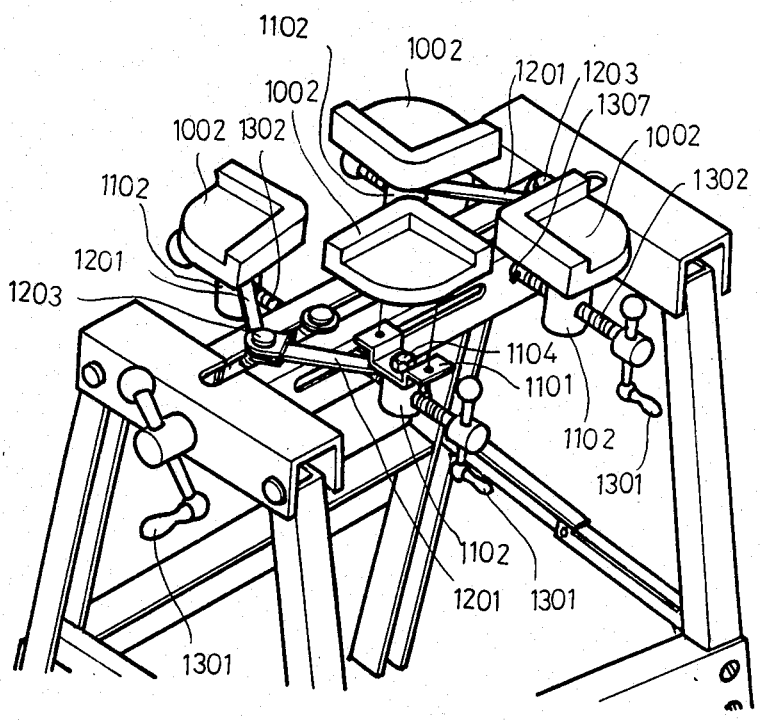
Figures 1, 4:
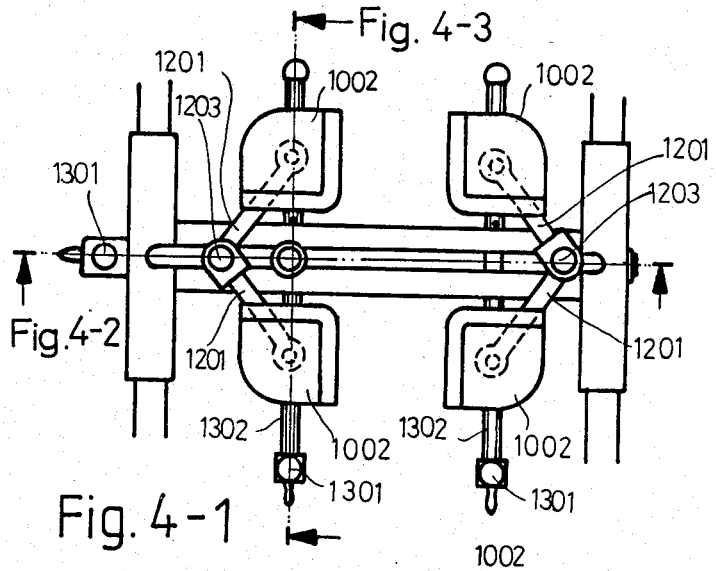
Figures 2, 4:
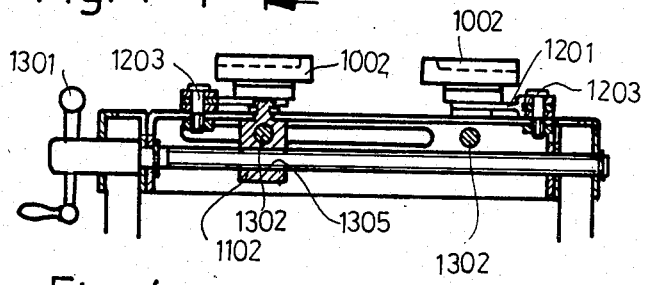
Figures 3, 4:
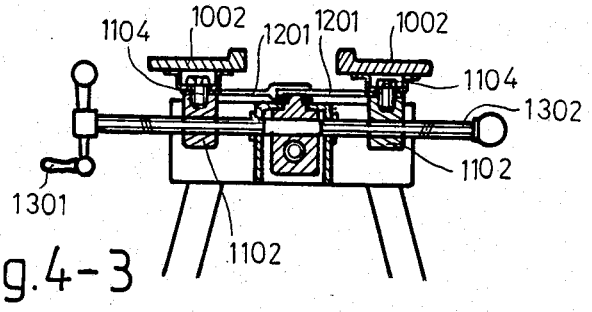
Figure 5:
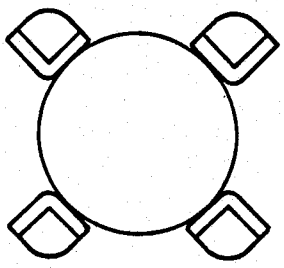
Figures 1, 5:
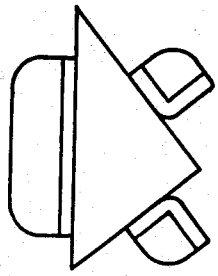
Figures 2, 5:
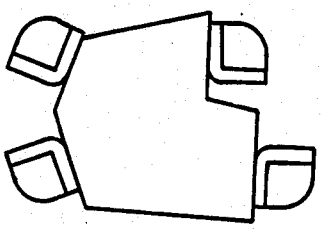
Figures 3, 5:
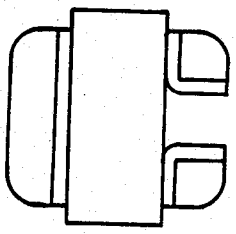
Figures 4, 5:
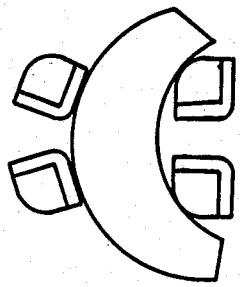
Figure 5:
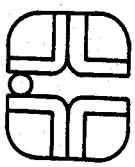
Figures 5, 6:
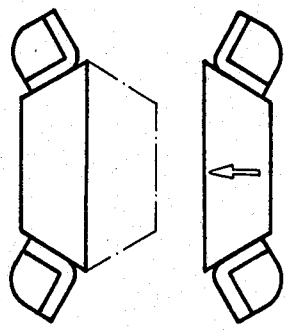
Figures 5, 6, 7:
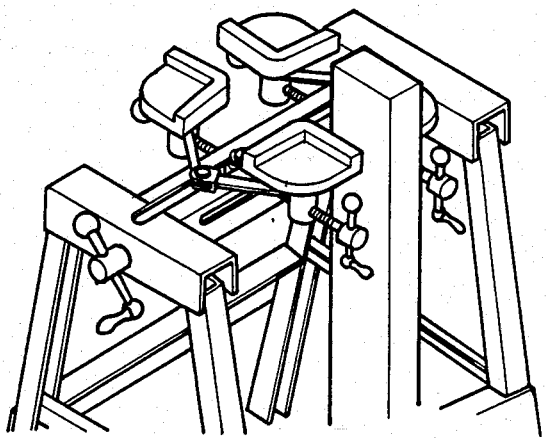

FIG. 3-1 is the top view of the preferred embodiment of the side-side three handle operational and control pull-rod four jaw type clamp work bench; FIG. 3-2 is the side cross sectional view A of the clamp jaw set of the single-side three handle operational and control pull-rod four jaw type clamp work bench; FIG. 3-3 is side cross sectional view B along the central line of the single-side three handle operational and control pull-rod four jaw type clamp work bench; FIG. 3-4 is the front view of the preferred embodiment of the single-side three handle operational and control pull-rod four jaw type clamp work bench; FIG. 3-5 is the preferred embodiment of the single-side three handle operational and control pull-rod four jaw type clamp work bench in which the four sets of links are changed to two sets of links; the middle parallel slots are only provided with one set of link joint 1202 of the post with central threads, to couple two sets of links 1201. This design applies to smaller machines, thus saving costs. Its main feature lies in that the link is made by two sets of link joints 1202 of the post with central threads that constitute a joined joint which goes through and is placed in the post with central threads. The links on its two ends couple to the left and right parallel slot-shaped structure connected to the central rod 1203 of the link joint placed in the middle side of the left and right parallel slot-shaped structure.

FIG. 4 is the view of another embodiment of the double-side three handle operational and control pull-rod four jaw type clamp work bench; FIG. 4-1 is its top view, FIG. 4-2 is its side cross sectional view; and FIG. 4-3 is its front cross sectional view. This uses the horizontal positioning nature of the link to support the clamp jaw set 1002. The clamp jaw set 1002 is not added with any lengthwise guide rails, but the two ends (with a mutually different screw direction) of a guide rod are respectively coupled to the slide block 1102 of the left and right sets on the same side. Links 1201, respectively, pass through the place between the short shape support board 1101 pivoted on the slide block 1102 and the movable clamp jaw, but link 1201 uses the central rod 1203 and the middle guide rail for slide lengthwise coupling and also to prevent the slide block 1102 from rotating along the said screw, thereby providing the horizontal stable functions. This design does not have parallel guide rails on its both sides, thus making the insertion of a work piece into it very convenient and also greatly widening the scope to clamp a work piece such as a French door for repair.

Summing all the above up, in this invention, the link is used as an auxiliary structure to achieve the convenience of the single-side operations for said work bench or to enhance the scope to clamp a work piece; and this design is considered very helpful to the user.

I claim:

1. A vise structure comprising a frame having respective first and second end portions longitudinally of the frame, a first vise jaw at the first end portion of the frame and arranged substantially transversely thereof, means for guiding the first vise jaw on the frame for movement longitudinally of the frame in a direction from the first end portion to the second end portion of the frame, a pair of pivotably-mounted second vise jaws spaced apart from one another at the second end portion of the frame, means for guiding the respective second vise jaws towards and away from one another at the second end portion of the frame and in a direction substantially transverse to the longitudinal movement of the first vise jaw, rod means rotatably journaled in the frame, manually-manipulatable handle means associated with the rod means, the rod means including a threaded inner rod and a threaded outer rod, first nut means carried by the outer rod and connected to the first vise jaw, whereby the first vise jaw moves longitudinally of the frame in response to rotation of the outer rod, second nut means carried by the inner rod, respective linkage means connecting the second nut means to the second vise jaws, whereby the second vise jaws move transversely of the frame in response to rotation of the inner rod, and means associated with the handle means for selectively effecting rotation of either the inner rod, the outer rod, or both the inner and outer rods upon rotation of the handle means.

2. The vise structure of claim 1, wherein said last-named means associated with the handle means comprises a sleeve carried by the handle means and mounted in the frame for respective rotational and limited longitudinal movement therein, the outer rod having an end, the inner rod being received telescopically within the outer rod and having an end extending beyond the respective end of the outer rod, the respective ends of the inner and outer rods being telescopically received within the sleeve upon selected longitudinal movement of the sleeve relative to the frame, at least one pair of first and second pins carried by the sleeve and extending radially within the sleeve, and at least one pair of first and second communicating longitudinal keyways formed in the inner and outer rods, respectively; wherein the sleeve has a first position relative to the frame, a second retracted position relative to the frame, and a third still further retracted position relative to the frame; whereby in the first position of the sleeve, the first and second pins are received only in the first longitudinal keyway in the inner rod, thereby effecting rotation of the inner rod upon rotation of the handle means and the sleeve carried thereby; whereby in the second position of the sleeve, the first pin is received in the first keyway, and the second pin is received in the second keyway, respectively, thereby effecting rotation of the inner rod and the outer rod upon rotation of the handle means; and whereby in the third position of the sleeve, the first and second pins are received only in the second keyway of the outer rod, thereby effecting rotation of the outer rod upon rotation of the handle means.

3. A vise structure comprising a frame, at least two movable vise jaws carried by the frame and articulatable thereon, rod means rotatably journaled in the frame below the vise jaws, a handle associated with the rod means and having a sleeve formed integrally therewith, the rod means including a threaded inner rod and a threaded outer rod, first nut means engaged by the outer rod and connected to one of the vise jaws, whereby said one vise jaw moves relative to the frame in response to rotation of the outer rod, second nut means engaged by the inner rod and connected to the other of the vise jaws, whereby said other vise jaw moves relative to the frame in response to rotation of the inner rod, the inner rod being telescopically received within the outer rod, the outer rod having a respective end portion, the inner rod having a respective end portion extending beyond the respective end portion of the outer rod; wherein the sleeve has a first longitudinal position relative to the frame in which the sleeve is telescopically received over the respective end portion of the inner rod, means coupling the sleeve only to the respective end portion of the inner rod for rotation in unison in the first position of the sleeve, thereby moving only said other vise jaw upon rotation of the handle; wherein the sleeve has a second longitudinal position which is retracted within the frame relative to the first position of the sleeve, such that the sleeve is telescopically received over both respective end portions of the inner and outer rods, means coupling the sleeve to the respective end portions of both the inner and outer rods for rotation in unison in the second position of the sleeve, thereby moving both vise jaws upon rotation of the handle; and wherein the sleeve has a third longitudinal position which is further retracted within the frame relative to the second position of the sleeve, such that the sleeve is further telescopically received over the respective end portions of the inner and outer rods, and means coupling the sleeve only to the respective end portion of the outer rod for rotation in unison in the third position of the sleeve, thereby moving only said one vise jaw upon rotation of the handle.

* * * * *